United States Patent [19]

Garcia

[11] Patent Number: 4,724,740

[45] Date of Patent: Feb. 16, 1988

[54] RECOILING MORTAR MOUNTED ON A REVOLVING PLATFORM

[75] Inventor: Jose G. Garcia, Vizcaya, Spain

[73] Assignee: Esperanza y Cia, S.A., Spain

[21] Appl. No.: 884,398

[22] Filed: Jul. 11, 1986

[30] Foreign Application Priority Data

May 26, 1986 [ES] Spain ..... 555318

[51] Int. Cl.[4] ..... F41F 1/06

[52] U.S. Cl. ..... 89/37.05; 89/43.01

[58] Field of Search ..... 89/1.3, 1.35, 37.05, 89/40.02, 43.01

[56] References Cited

U.S. PATENT DOCUMENTS

| | | | |
|---|---|---|---|
| 410,968 | 9/1889 | Canet | 89/37.05 |
| 456,016 | 7/1891 | Canet | 89/43.01 |
| 480,215 | 8/1892 | Spiller | 89/37.05 |
| 2,413,703 | 1/1947 | Fischer | 89/1.35 |

FOREIGN PATENT DOCUMENTS

| | | | |
|---|---|---|---|
| 75634 | 4/1983 | European Pat. Off. | 89/37.05 |
| 792740 | 1/1936 | France | 89/1.3 |
| 1269185 | 7/1961 | France | 89/37.05 |
| 2552218 | 3/1985 | France | 89/37.05 |

*Primary Examiner*—Stephen C. Bentley
*Attorney, Agent, or Firm*—Lucas & Just

[57] ABSTRACT

A recoiling mortar mounted on a revolving platform which comprises a barrel resting at the rear upon a first support attached to a sleigh which holds said barrel, where the whole assembly slides upon a chassis which rests on the revolving platform, and is provided with a fluid operated cylinder attached to the chassis and its plunger to the sleigh.

15 Claims, 4 Drawing Figures

RECOILING MORTAR MOUNTED ON A REVOLVING PLATFORM

When it is proposed to install a mortar upon a vehicle where it can fire in any direction, it is necessary to provide a sturdy base to support a revolving platform.

This base generally rests upon the vehicle bottom plating or armouring which is stiffened by means resting on the sides of said vehicle.

The reason for all this is that since the mortar is a front-loading weapon which fires into the second range sector (with an elevation angle above 45°), its supporting point must be kept as low as possible, while at the same time, since the mount of the weapon needs to be positioned at such a height that it can be easily loaded, these weapons either have no recoil travel or a very limited recoil travel, which means that said platform is in any event required to withstand exceedingly high stresses.

The first difficulty that arises with this kind of platform is its levelness, because data used for aiming is always on the basis of two angles, these being the azimuth of bearing, and the elevation or range.

If the platform is horizontal, there is no difficulty whatsoever, but if it slopes, the problem of the rotation of the reference axes must be worked out, and in addition, whenever the target is changed, the problem must likewise be solved.

With systems using perpendicular aiming devices where the aiming device is suspended on an axis parallel to the axis of the barrel, and the position of its center of gravity ensures the transverse levelness of its optical instrument, the problem is simplified because the firing plane and the viewing plane (these being vertical planes which intersect the bore and visual axis with direction finder at zero) are always parallel and almost coincidental.

With these aiming or laying systems, which are the most readily understood, it is simply necessary to set the elevation and bearing angles on the graduated scale and then operate the elevation and bearing setting screws to bring the sight onto the target reference, and finally secure the elevation level whereupon the weapon is in the aimed condition.

This procedure which can be so radily explained is not nearly so easy to execute, particularly when the slope of the platform is steep, because if the laying mechanisms provide the platform with perpendicular vertical motion, then, whenever the angle of elevation is altered, the bearing is altered too and vice-versa, which means that laying would involve successively setting the elevation and the bearing adjustments, where this requires a good measure of practice.

To obviate these problems, it is obviously necessary to resort to levelling the platform, which, among others, may be achieved by adopting the following procedures:

(a) to level the vehicle (which, in addition to involving a complex process, is not in this case advisable because the rigid levelling points would, when the weapon is fired with, in this instance, a recoil force amounting to many tons, removal all flexibility from the suspension and subject said vehicle to exceedingly high bending stresses);

(b) to level the platform (which is inadvisable due to the high stresses to be withstood at the levelling axes upon firing) particularly when it is remembered that the mortar is a weapon where the requirements are for great simplicity, a good firing sequence and duration.

A further problem that often arises with these systems is the position of the aiming instrument, which is always attached onto the carriage, but since the elevation angles can vary widely, the aiming instrument will sometimes suffer a change in its position (in height) which means that lifting rods need to be used with the ensuring aiming errors brought about by the inevitable gaps.

In addition to what has been said, it must also be remembered that due to the long ranges required of these weapons and the lightness of the vehicles which carry them, the maximum percussion force upon firing must be minimized, and this can only be accomplished with a recoil damper. Such a component needs to be suited to the weapon because it must produce a stress which is the maximum to be withstood by the vehicle, and it must have as short a recoil travel as possible in order to facilitate front loading as mentioned previously.

A further requirement to be fulfilled by a mounting of this type is the ability to remove the barrel quickly for use upon the ground, and also the ability for it to be replaced just as speedily upon its carriage.

The improvement or ameliorations in platform mountings for vehicle mounted mortars covered by this patent attempt to achieve the following purposes:

(1) To achieve such a mounting that the point that withstands the firing recoil rests direclty upon the optimum point on the revolving platform which possesses sufficient strength.

(2) To ensure that the aiming mechanisms (which provide the barrel with its motion) do not in theory withstand any stresses caused by the shot (on vibrations proper to the platform).

(3) To provide such aiming mechanisms with a levelling system such that for each fixed position of the base platform, there is a levelled aiming sector.

(4) To arrange said aiming mechanisms in such a way that the base of the direction finder is kept essentially at one single height (in order for aim to be taken through the upper hatch in armour plated vehicles).

(5) To provide the barrel with a recoil damper to ensure constant stressing throughout its whole recoil travel range that is compatible with the vehicle in order for such travel, due to its being minimal, will allow forward loading.

(6) To ensure that for every position of the platform, there is a horizontal firing sector which allows changes of target which are limited to said sector.

(7) To enable the barrel to be speedily and safely placed in position and removed therefrom.

A slewing platform (2) has the mortar assembly (3) mounted upon the top of it, and the whole is fitted onto a vehicle (1).

Figure 4:
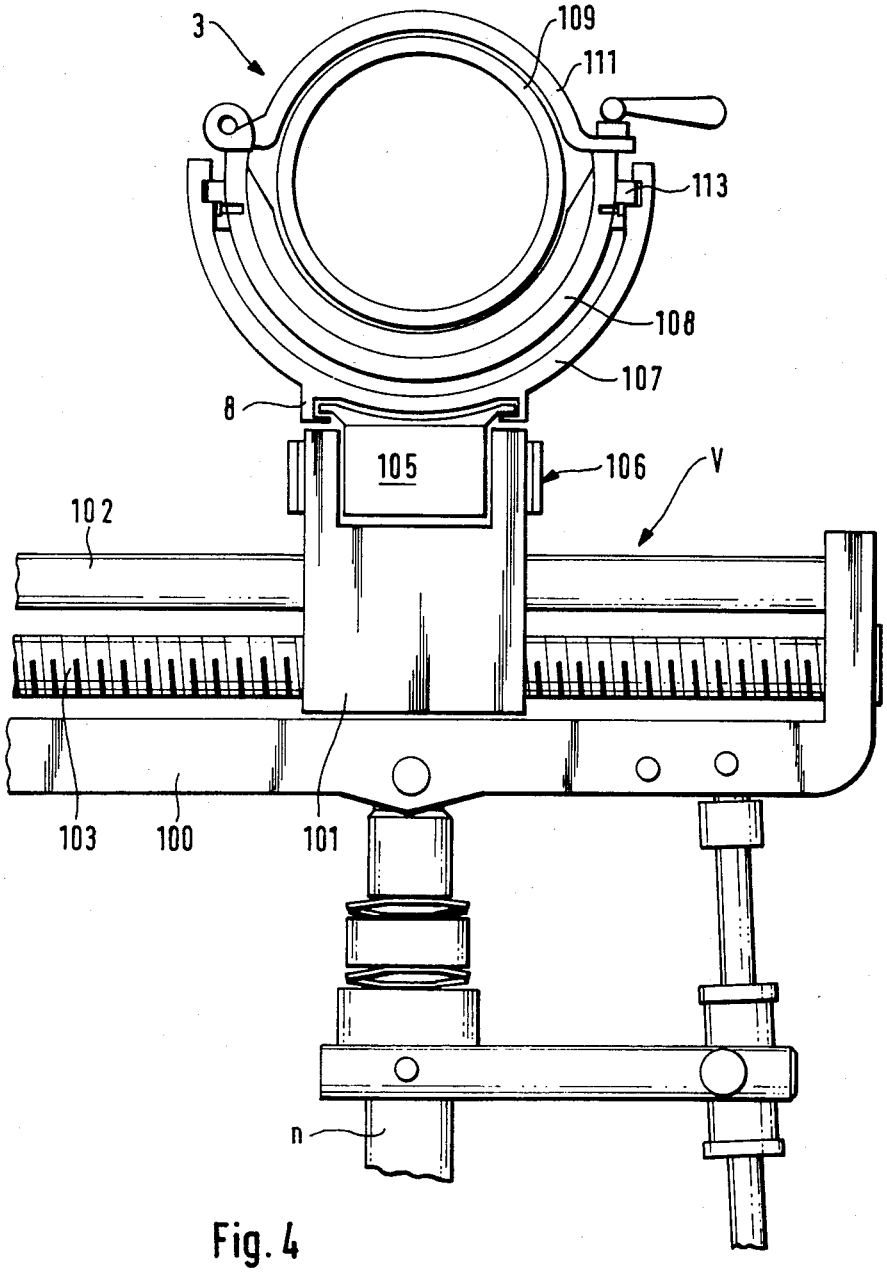
FIG. 4 is a front view of the barrel (109) amounting upon the recoil sleigh (108) and upon the chassins (107).

The barrel (109) is supported at its rear with its ball (110) in the first seating (4) which solidly is attached to a sleigh (108) upon which the barrel (109) rests (See FIG. 4), where said barrel (109) is secured to said sleigh (108) by means of one or more brackets (111) attached to the sleigh (108).

Sleigh (108) possesses guide pieces (113) for its short travel range upon a chassis (107) which rests with its ball (112) in the second seating (5) attached to the revolving platform (2).

Both the chassis (107) as well as the sleigh (108) are constructed from longitudinally slotted tubes to facilitate the mounting and removal of the top of the barrel (109).

The center of rotation ($0_1$) of the second seating (5) and the center of rotation ($0_2$) of the first seating (4) are coaxial to center line (e) of the barrel (109). The same applies to balls (112) and (110) with respect to center line (e) of the barrel (109).

Revolving platform (2) is fitted with a sub-platform (7) which rocks about an axis $\overline{AB}$ in such a manner that when the platform is horizontal, said axis $\overline{AB}$ intersects axis $\overline{0_1 0_2 e}$, while points $0_1$, A and B lie preferably upon a straight line.

Arm (m), of constant dimensions, and arm (n) of a variable length by screwed spindle are pivotally attached to sub-platform (7), and they are joined to the chassis (107) by means of a sliding support (V). (See FIG. 4).

Arm (n), whose length is variable in this practical construction, terminates in an inclinable bracket (100) which allows for fine adjustment of the transverse slope which has previously been set by means of sub-platform (7).

In the deflection mechanism, screwed spindle (103) makes flange (101) travel along slide (102), and with it the whole mortar(3) is shifted sideways.

Skid (105), which freely rotates with its shaft (106) inside flange (101), is able to travel along the longitudinal slides (8) provided on the bottom of the chassis (107).

When the firing angle is altered, the aiming instrument describes an arc about point T, the curve of which is very small and represent the slight difference in the height of said aiming instrument at varying positions of the barrel (109).

To produce the barrel (109) recoil dampening effect, a fluid operated restrainer is provided which is essentially comprised of a plunger ($B_1$) attached to the sleigh (108) and to a cylinder ($A_1$), secured to the chassis (107), although obviously the components and means connected to cylinder ($A_1$) and plunger ($B_1$) to oppose displacement of the fluid may be changed about.

A description is now given of two practical constructions of the recoil dampening system.

Figure 1:
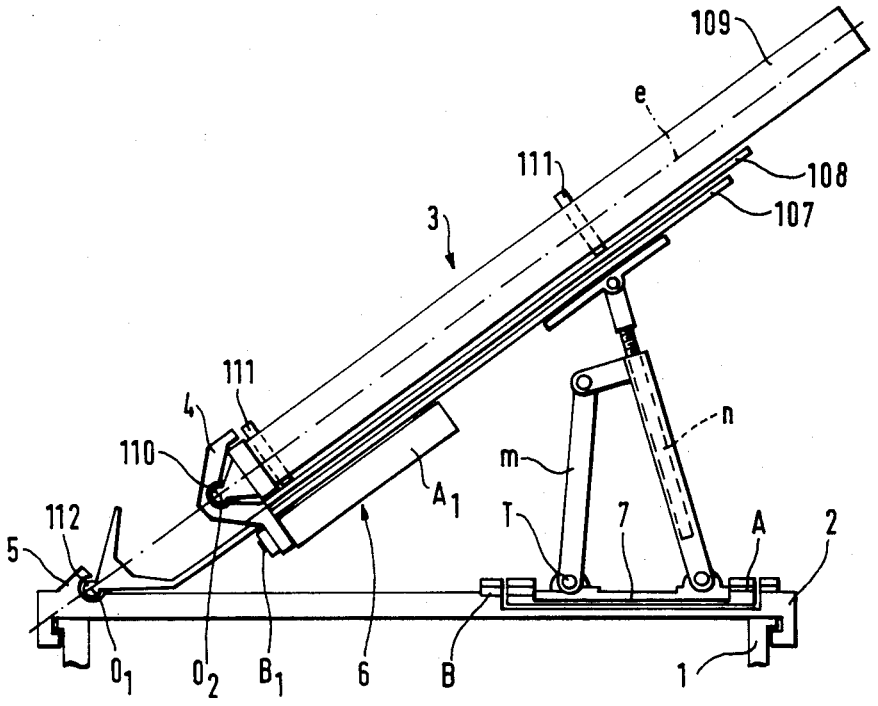
FIG. 1 is a side view of the mortar with its essential parts.
Figure 2:
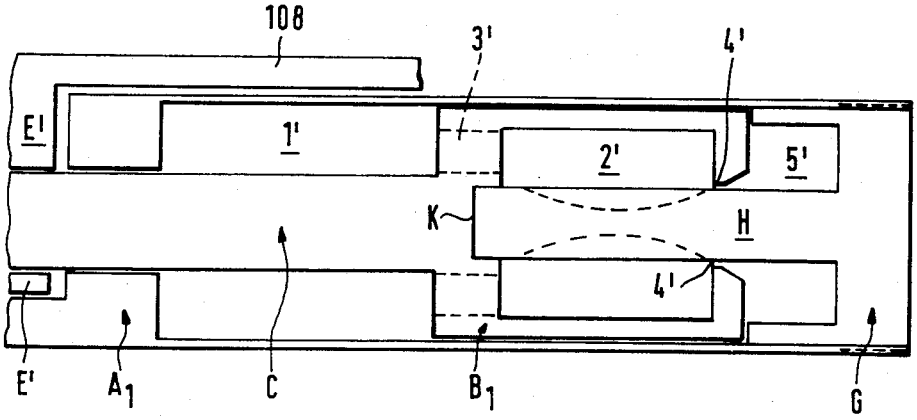
FIG. 2 is a cross section view of a first practical construction of the recoil damper.

FIG. 2 shows a dampening system with a counter-plunger, and it comprises a cylinder ($A_1$) connected to the chassis (107), in whose interior slides plunger ($B_1$), the stem (C) of which is attached to appendix (E) that is secured to the recoil absorbing mass or the sleigh (108).

The front end of cylinder ($A_1$) is enclosed by means of seal (G) which acts as the bottom and holds the variable section counter-plunger (H).

In the idle position, the end of counter-plunger (H) is accommodated inside the cavity (K) of plunger thus forming a battery entrance brake.

Operation is as follows:

All the inside of the cylinder is filled with brake fluid of the kind used in artillery applications (glycerine).

When a shot is fired, the recoil absorbing mass (E) begins to travel rearwards and takes with it the stem (C) thus causing plunger ($B_1$) to travel back.

The fluid inside the space (1') passes through ample sized holes (3') in plunger ($B_1$) and enters chamber (2'), whence it goes to the front of cylinder (5') through annular space (4') between the counter-plunger (H) and the pointed front end of cylinder head ($B_1$).

This annular space (4') is designed so that due to the acceleration of the fluid, it will provide a constant force throughout the whole travel range.

When the recoil absorbing mass ceases to travel, the return springs make it move forward again, and to prevent the final recoil blow, the end of counter-plunger (H) goes into the small cylinder (K) which posesses plunger (C) at the front, and due to the non-compressable nature of the fluid enclosed inside (K) and which has to emerge through the gap that exists between said cylinder and the end of the counter-plunger, a dampening effect is achieved to minimize recoil stresses.

Chamber (5') needs to be as large as possible, because it should contain a small volume of air in order to offset the effect of swelling and shrinking.

Figure 3:
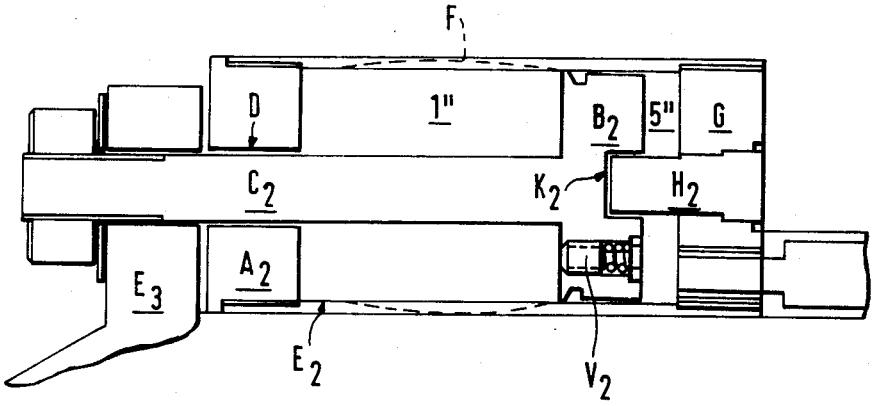
FIG. 3 is a cross section view of a second practical construction of the recoil damper.

FIG. 3 shows a recoil dampening system with a variable diameter, and this comprises a cylinder ($A_{2-E2}$) attached to the chassis (107) (rigid point to withstand recoiling), and inside said cylinder slides plunger ($B_2$) whose stem ($C_2$) is secured to the sleigh (108), where this part slides upon the chassis (107) that carries the barrel (109)).

The bottom of the cylinder ($E_2$) is fitted with the plunger counter-stem ($H_2$), which in this arrangement, solely acts as a recoil dampener when its end enters housing ($K_2$) on the plunger.

Excess pressure valve ($V_2$), which only operates if the pressure exceeds the normal value, is fitted onto the plunger.

Operation is as follows:

When the shot is fired, the recoil absorbing mass (sleigh) (108) exerts a pull on stem ($C_2$) by means of its appendix ($E_3$), and causes plunger to travel back.

The fluid inside (1'') moves into the front section (5'') through the space that exists between the plunger head ($B_2$) and the cylindrical section ($E_2$), which in this case possesses a variable section (detail F) against a constance restraint.

When, through the effect of a spring, the end of plunger counter-stem ($H_2$) return to the intial recoil dampening position and enters into cavity ($K_2$), the plunger exerts further restraint.

Return to the original position may in any case be effected by springs, flexible means, or fluidics.

Moreover, the barrel supporting balls and the chassis may be replaced by other means of support instead.

I claim:

1. A recoiling mortar for mounting on a revolving platform comprising:

(a) a barrel having a butt end and a muzzle end;

(b) a first seating ball attached to said butt end of said barrel;

(c) a first support in which said first seating ball rests;

(d) a second seating ball;

(e) a second support in which said second seating ball rests, said second support attached to the platform;

(f) a chassis attached to said second seating ball;

(g) a sleigh which is releasably attached to said barrel, said sleigh also attached to said first support, said sleigh slidable in said chassis; and (h) a dampening means for dampening recoil of said barrel, said dampening means comprising a plunger and a cylinder, said plunger attached to either said first support means of said chassis and said cylinder attached to either the first support means or said chassis whichever is not attached to said plunger.

2. The mortar of claim 1 wherein said first seating ball has an axis of rotation and said second seating ball has an axis of rotation and said barrel has a center line, said first seating ball, said second seating ball and said barrel being arranged such that said axis of said first seating ball, said axis of said second seating ball and said center line of said barrel are coaxial.

3. The mortar of claim 1 wherein said barrel has a center line, and said chassis has longitudinal slides that are attached to said chassis parallel to said center line of said barrel, and said mortar further comprising a deflection means for adjusting the deflection of said barrel, said deflection means having a flange, said flange slidable in said longitudinal slides of said chassis.

4. The mortar of claim 1 wherein said sleigh is releasably attached to said barrel by means of a quick release clamp and wherein said chassis and said sleigh are troughs running longitudinally along a portion of the barrel from butt end to muzzle end.

5. The mortar of claim 1 wherein said dampening means exerts a constant force to oppose recoil.

6. The mortar of claim 2 further comprising:

(i) a sub-platform rockably mounted in the platform;

(j) a deflection means for adjusting the deflection of said barrel, said deflection means attached to said chassis near the muzzle end of said barrel;

(k) an adjustable arm pivotally mounted at one end to said sub-platform and pivotally attached at the other end to said deflection means; and (l) a constant length arm pivotally mounted at one end to said sub-platform and pivotally attached at the other end to said adjustable arm.

7. The mortar of claim 6 wherein said cylinder of said dampening means contains fluid and said dampening is accomplished by the passage of fluid from one side of the plunger to the other through a variable gap designed so that a constant force opposes said recoil.

8. The mortar of claim 5 wherein the cylinder of said dampening means possesses a counter-stem which under conditions of recoil enters into a small housing formed in said plunger.

9. The mortar of claim 6 wherein said sub-platform has an axis of rotation, said sub-platform being arranged such that said axis of rotation of said sub-platform intersects the axis of rotation of said first seating ball, the axis of rotation of said second seating ball and said center line of said barrel.

10. A recoiling mortar for mounting on a revolving platform comprising:

(a) a barrel having a butt end and a muzzle end;

(b) a first seating ball attached to said butt end of said barrel;

(c) a first support in which said first seating ball rests;

(d) a second seating ball;

(e) a second support in which said second seating ball rests, said second support attached to the platform;

(f) a chassis attached to said second seating ball;

(g) a sleigh which is releasably attached to said barrel, said sleigh also attached to said first support, said sleigh slidable in said chassis;

(h) an adjustable arm at one end pivotally attached to said chassis and at the other end pivotally attached to the platform; and (i) a dampening means for dampening recoil of said barrel, said dampening means comprising a plunger and a cylinder, said plunger attached to either said first support means or said chassis and said cylinder attached to said first support means or said chassis whichever is not attached to said plunger.

11. The mortar of claim 10 wherein said sleigh is releasably attached to said barrel by means of a quick release clamp and wherein said chassis and said sleigh are troughs running longitudinally along a portion of the barrel from butt end to muzzle end.

12. The mortar of claim 10 wherein said first seating ball has an axis of rotation and said second seating ball has an axis of rotation and said barrel has a center line, said first seating ball, said second seating ball and said barrel being arranged such that said axis of said first seating ball, said axis of said second seating ball and said center line of said barrel are coaxial.

13. A recoiling mortar for mounting on a revolving platform comprising:

(a) a barrel having a butt end and a muzzle end;

(b) a first seating ball attached to said butt end of said barrel;

(c) a first support in which said first seating ball rests;

(d) a second seating ball;

(e) a second support in which said second seating ball rests, said second support attached to the platform;

(f) a chassis attached to said second seating ball;

(g) a sleigh which is releasably attached to said barrel, said sleigh also attached to said first support, said sleigh slidable in said chassis;

(h) a dampening means for dampening recoil of said barrel, said dampening means comprising a plunger and a cylinder, said plunger attached to either said first support means or said chassis and said cylinder attached to said first support means or said chassis whichever is not attached to said plunger;

(i) a sub-platform rockably mounted in the platform;

(j) a deflection means for adjusting the deflection of said barrel, said deflection means attached to said chassis near the muzzle end of said barrel;

(k) an adjustable arm pivotally mounted at one end to said sub-platform and pivotally attached at the othe end to said deflection means; and (l) a constant length arm pivotally mounted at one end to said sub-platform and pivotally attached at the other end to said adjustable arm.

14. The mortar of claim 13 wherein said first seating ball has an axis of rotation and said second seating ball has an axis of rotation and said barrel has a center line, said first seating ball, said second seating ball and said barrel being arranged such that said axis of said first seating ball, said axis of said second seating ball and said center line of said barrel are coaxial.

15. The mortar of claim 14 wherein said sub-platform has an axis of rotation, said sub-platform being arranged such that said axis of rotation of said sub-platform intersects the axis of rotation of said first seating ball, said second seating ball and said center line of said barrel.

* * * * *

UNITED STATES PATENT AND TRADEMARK OFFICE

CERTIFICATE OF CORRECTION

PATENT NO. : 4,724,740

DATED : February 16, 1988

INVENTOR(S) : Jose Garcia Garcia

It is certified that error appears in the above-identified patent and that said Letters Patent are hereby corrected as shown below:

Column 1, line 47, change "radily" to --readily--.

Column 1, line 63, change "removal" to --remove--.

Column 2, line 26, change "improvement" to --improvements--.

Column 2, line 61, change "chassins" to --chassis--.

Column 3, line 40, change "represent" to --represents--.

Column 5, line 36, change the dependency from "claim 6" to --claim 5--.

Column 6, line 46, change "othe" to --other--.

Signed and Sealed this

Ninth Day of August, 1988

*Attest:*

*Attesting Officer*

DONALD J. QUIGG

*Commissioner of Patents and Trademarks*